United States Patent [19]

Masuda

[11] 4,321,066

[45] Mar. 23, 1982

[54] ELECTRIC DUST COLLECTING APPARATUS

[76] Inventor: Senichi Masuda, No. 605, Nishigahara 1-40-10, Kita-ku, Tokyo-to, Japan

[21] Appl. No.: 182,030

[22] Filed: Aug. 28, 1980

[51] Int. Cl.[3] ..... B03C 3/10

[52] U.S. Cl. ..... 55/114; 55/121; 55/128; 55/131; 55/146; 55/149

[58] Field of Search ..... 55/109, 113, 114, 121, 55/128, 131, 146, 149, 117

[56] References Cited

U.S. PATENT DOCUMENTS

| | | | |
|---|---|---|---|
| 2,866,546 | 12/1958 | Roberts | 55/121 |
| 3,028,714 | 4/1962 | Mayer | 55/114 |
| 3,375,638 | 4/1968 | Dungler | 55/131 |
| 3,701,236 | 10/1972 | Rotsky et al. | 55/114 |
| 4,185,971 | 1/1980 | Isahaya | 55/113 |

FOREIGN PATENT DOCUMENTS

| | | | |
|---|---|---|---|
| 550372 | 3/1923 | France | 55/146 |
| 40-26558 | 12/1965 | Japan | 55/149 |
| 50-65969 | 6/1975 | Japan . | |
| 52-37275 | 3/1977 | Japan | 55/131 |

*Primary Examiner*—David L. Lacey

*Attorney, Agent, or Firm*—Price, Heneveld, Huizenga & Cooper

[57] ABSTRACT

An endless belt-shaped dust collecting electrode is extended around a pair of rollers disposed within a casing, discharge electrodes are disposed within a chamber formed between the upper side portion and lower side portion of the endless belt-shaped dust collecting electrode, end portions of a hanger support for the discharge electrodes project to the outside of the casing through gas communication ports formed in the casing, and these end portions of the hanger support are fixedly supported and electrically insulated from the outside of the casing, whereby insulation between the discharge electrodes and the dust collecting electrode can be improved even when electrically conductive dust is collected.

15 Claims, 5 Drawing Figures

ELECTRIC DUST COLLECTING APPARATUS

The present invention relates to an electric dust collecting apparatus.

Heretofore known electric dust collecting apparatuses generally comprise, as a basic structure, wire-shaped or rod-shaped discharge electrodes and a plate-shaped dust collecting electrode disposed in an opposed relationship to the discharge electrodes. The present invention provides further improvements in the electric dust collecting apparatus developed previously by the inventor of this invention which improvement has an endless belt-shaped dust collecting electrode rotatably extended around rollers and disposed in an opposed relationship to wire-shaped or rod-shaped discharge electrodes.

It is one object of the present invention to improve insulation between a discharge electrode and a dust collecting electrode even if dust consists of conductive materials.

Another object of the present invention is to collect the dust deposited on a dust collecting electrode by peeling off the deposited dust so that it may not be resputtered, that is, reentrained.

Yet another object of the present invention is to avoid the risk of lowering the dust collecting efficiency by resputtering the peeled off dust into the dust-containing gas as is the case when the dust deposited onto a dust collecting electrode is peeled off as by hammering.

According to one feature of the present invention, there is provided an electric dust collecting apparatus, in which an endless belt-shaped dust collecting electrode is extended around and supported by rollers. The dust collecting electrode is driven and forms a chamber therewithin with discharge electrode frames for supporting discharge electrodes within said chamber. This structure is provided within a casing and end portions of a discharge electrode hanger support for supporting said discharge electrode frames are supported as projected out of the casing are gas communication ports such as gas discharge ports or a gas inlet duct.

Figure 3:
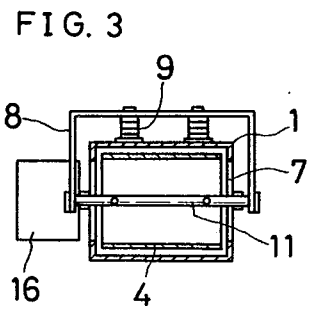
Figure 1:
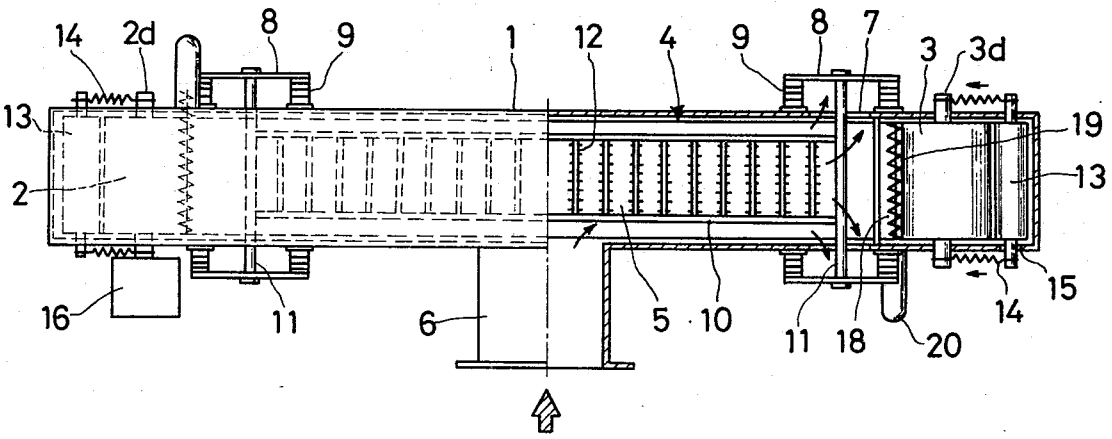
Figure 2:
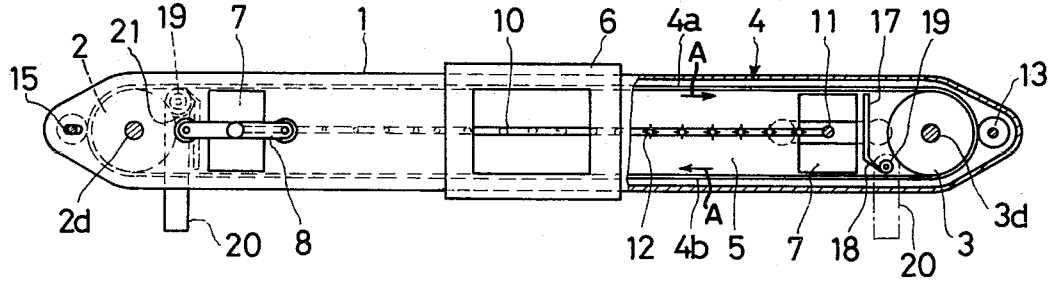
Figure 4:
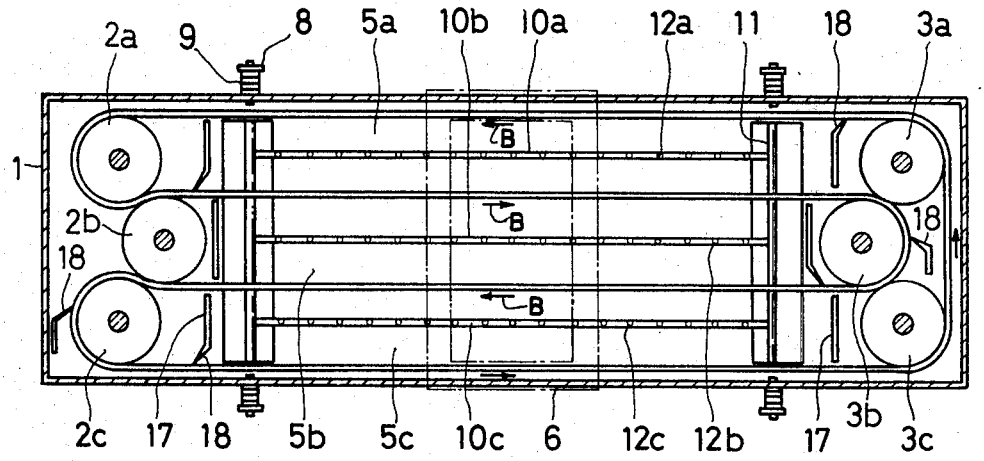
Figure 5:
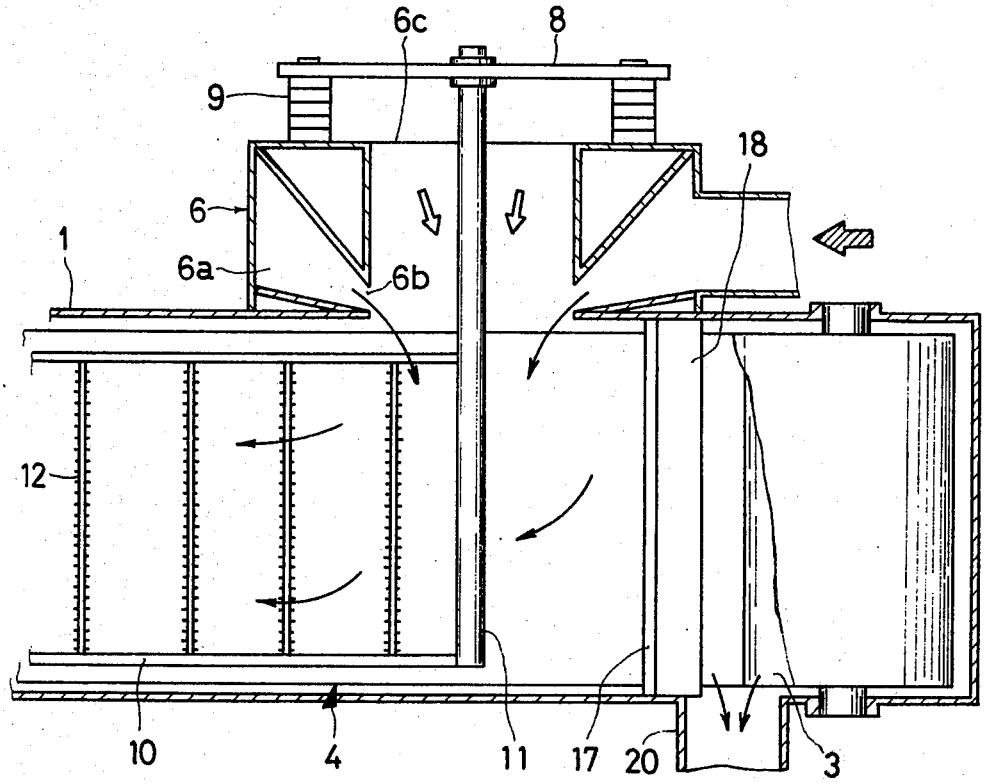

The above-mentioned and other objects and features of the present invention will become more apparent by reference to the following description taken in conjunction with the accompanying drawings, wherein:

FIG. 1 is a plan view, partly in cross-section, of an electric dust collecting apparatus according to one preferred embodiment of the present invention, FIG. 2 is a front view, partly in cross-section, of the same apparatus, FIG. 3 is a cross-section view showing a supporting device for discharge electrodes in another preferred embodiment of the present invention, FIG. 4 is a longitudinal cross-section front view of still another preferred embodiment of the present invention, and FIG. 5 is an enlarged partial cross-section view of yet another preferred embodiment of the present invention.

Referring now to FIGS. 1 and 2 of the drawings, an endless belt-shaped dust collecting electrode 4 FIG. 2 is extended around a pair of rollers 2 and 3 which are pivotably supported at the opposite ends of a tubular casing 1 having a rectangular cross-section. An inlet duct 6 opening within a chamber 5 formed between an upper side portion 4*a* and a lower side portion 4*b* of the belt-shaped dust collecting electrode 4 is provided at the center of the front wall of the casing 1. It is to be noted that the dust collecting electrode 4, besides being a conductive sheet-like belt made of a stainless steel sheet may be a belt of various types, such as a wire netting belt, a chain-like belt, a grate-like belt, etc. Furthermore, a belt formed of a large number of sections divided in the circumferential direction could be employed.

At the opposite ends of a chamber 5 formed between the mutually opposed upper side portion 4*a* and lower side portion of the dust collecting electrode 4 and between the pair of rollers 2 and 3, on the front and rear side walls of the casing 1 are provided gas communication ports such as, for example, gas discharge ports 7 for discharging gas to the exterior gas from which dust has been removed. Also discharge electrode hanger supports 11, as will be described later, project outwardly.

The opposite ends of the hanger supports 11 project outwardly through the gas discharge ports 7, and are respectively supported from the side walls of the casing 1 by insulating supporting devices each consisting of a support beam 8 and insulators 9. A pair of discharge electrode frames 10 are disposed within the chamber 5 and extend lengthwise thereof while maintaining a predetermined distance between them. Their opposite ends are fixedly secured to the discharge electrode hanger supports 11 on the left and right and supported at a position centered vertically within the chamber 5. Reference numeral 12 designates discharge electrodes supported horizontally at predetermined intervals between the discharge electrode frames 10 as directed in the front-to-back direction. It is to be noted that the insulator 9 can be dried to keep it well insulated, if desired, as by blasting hot air thereto or associating a heater therewith.

Reference numeral 13 designates pressure rollers for pressing from the outside the dust collecting electrode 4 extended around the respective rollers 2 and 3. These pressure rollers 13, by their pressing force, between the respective rollers 2 and 3 and the pressure rollers 13 assist the compression of the dust adhered to the inner circumferential surface of the dust collecting electrode 4 and shaping it into a cake form. Reference numeral 14 designates springs for bringing the pressure rollers constantly into pressing contact with the rollers 2 and 3 at a constant pressing force. The spring 14 is mounted between the shafts of the corresponding roller 2 and pressure roller 13 or the corresponding roller 3 and pressure roller 13. In addition, in order that the pressure rollers 13 can be always effectively brought into pressing contact with the respective rollers 2 and 3, the shafts of the pressure rollers 13 are pivotably supported through elongated holes 15 having their longer diameters directed in the left and right directions as viewed in FIGS. 1 and 2 formed in the casing wall surface so that movement of a limited length in the left and right directions of the shafts may be allowed. Reference numeral 16 designates an electric motor coupled to one of the rollers 2 for driving the dust collecting electrode 4.

Reference numeral 17 designates partition plates provided inside the chamber 5 adjacent to the respective rollers 2 and 3 at the opposite ends of the chamber 5. At the upper or lower end of each partition plate 17 is mounted a scraper 18 whose tip end is brought into pressing contact with the inner circumferential surface of the belt-shaped dust collecting electrode 4. The tip end is directed in the opposite direction to the direction of movement of the dust collecting electrode 4. Since the scraper 18 is provided for the purpose of peeling from the electrode 4 (and also from the rollers 2 and 3) the dust deposited onto the electrode 4 within the chamber 5 and compressed into a cake form between the electrode 4 and the roller 2 or 3. It is most desirable that the scraper 18 be so constructed that it may be brought into pressing contact with the electrode 4 and, if desired, also with the rollers 2 or 3 at the position where the electrode 4 comes, after it has passed through the chamber 5 and been pressed against the circumferential surface of the rollers 2 or 3.

Reference numeral 19 designates a screw conveyor for conveying out of the casing the cake or the like peeled off by the above-described scraper 18 and the cake or the like peeled from the dust collecting electrode 4 or the roller 2 or 3. This discharge is through a discharge pipe 20 projected from a side wall of the casing 1 concentrically with the screw conveyor 19. Assuming that the dust collecting electrode 4 is moving in the direction of the arrows A in the preferred embodiment illustrated in FIGS. 1 and 2, in order to externally discharge the cake peeled off on the side of the roller 3 the screw conveyor 19 could be provided along the lower side portion **4*b* of the dust collecting electrode 4. On the discharge side of the roller 2 a cake receiver 21 of, for example, cylindrical shape is provided jointly with the screw conveyor 19 at a predetermined height along the upper side portion 4*a* of the dust collecting electrode 4 to receive the cake from the cake receiver 21 and discharge it externally through a discharge pipe 20** provided at the same height.

In the dust collecting apparatus constructed as described above, a dust-containing gas such as, for example, an exhaust smoke or the like introduced through the inlet duct 6 is divided to flow to the left and the right in the chamber 5 within the casing 1 and discharged externally through the gas discharge ports 7 provided at the opposite ends of the casing 1. During this passage the dust contained in the gas is deposited on the inner surface of the moving belt-shaped dust collecting electrode 4 due to the electric field formed between the discharge electrodes 12 and the dust collecting electrode 4, whereby the dust-containing gas can be cleaned and the dust is retained. On the other hand, the dust deposited on the dust collecting electrode 4 is compressed into a cake between the dust collecting electrode 4 and the rollers 2 or 3, then peeled off by the above-mentioned respective scrapers 18, and discharged externally through the discharge pipes 20 with the aid of the screw conveyors 19.

It is to be noted that in an upright type of apparatus having the discharge electrodes 12 and the dust collecting electrode 4 disposed vertically, that is, in an apparatus in which the shafts **2*d* and 3*d* of the rollers 2 and 3 are directed in the vertical direction (Cf. FIG. 5), there is no need to provide the screw conveyors 19, as the peeled cake can be discharged by gravity through the discharge pipe 20. In this case the shape of the discharge pipes 20 could be modified, depending upon the functions to be achieved by the discharge pipe 20. In addition, in order to facilitate the peeling of the collected dust in the cake form from the dust collecting electrode 4, a modified structure could be employed in which water or other liquid can be sprayed or otherwise applied to the inner circumferential surfaces of the dust collecting electrode 4**.

FIG. 3 is a cross-section view showing a modified embodiment of the insulated supporting device for the discharge electrodes, in which the support beam 8 is formed in a downwardly opening U-shape, and insulators 9 are disposed between the upper horizontal arm of this U-shaped beam 8 and the upper outside surface of the casing 1. This provides a support for the entire discharge electrode assembly insulated from the casing 1.

FIG. 4 is a cross-sectional front view of a dust collecting apparatus having the chamber 5 constructed in a multi-chamber form while retaining the characteristic feature of the basic construction as described above. In this modified embodiment, the entire dust collecting electrode 4 is formed using a single, endless belt. The belt is extended successively around the three rollers **2*a*, 2*b* and 2*c* and the other three rollers 3*a*, 3*b* and 3*c*, respectively, disposed at the opposite ends of the casing 1 in the illustrated manner. The belt is driven in the direction of arrows B shown in FIG. 4. Consequently, within the casing 1 are formed three partitioned chambers 5*a*, 5*b* and 5*c*, and in the respective chambers discharge electrodes 12*a*, 12*b* and 12*c* are respectively disposed in opposed relationship to the dust collecting electrode 4. The remaining portions have substantially the same structure as the first preferred embodiment described above with reference to FIGS. 1 and 2, and component parts in this modified embodiment designated by the same reference numerals as those used in FIGS. 1 and 2 have like names and functions to those in FIGS. 1 and 2**.

FIG. 5 is a partial enlarged cross-sectional view showing one example of a vertical type of dust collecting apparatus in which a discharge electrode hanger support 11 is suspended within an inlet duct 6 serving as a gas communication port. An inlet duct 6 is provided at each end of the casing 1. In this example, the inlet duct 6 is cylindrical and an air inlet port **6*c* at the center of the inlet duct 6 communicates with the interior of the chamber 5. An annular hollow space 6*a* is formed within the inlet duct 6 such that a dust-containing gas introduced into the annular hollow space from the right in the direction of the arrow in FIG. 5 may be ejected obliquely inwardly towards the chamber 5 through an annular ejection port 6*b* formed along the inner circumference of the annular hollow space 6*a* close to the casing 1. Consequently, owing due to an ejector or venturi action, ambient air not containing dust is caused to flow into the apparatus through the air inlet port 6*c* at the center of the duct 6 simultaneously with the introduction of the dust-containing gas thereby preventing the deposit of dust on the discharge electrodes which would lower discharge effect. It is to be noted that in this modified example, since the dust collecting electrode 4 is disposed vertically, the dust cake peeled off by the scrapers 18 naturally falls into the discharge pipe 20**.

Moreover, it is to be noted that the above-described inlet duct structure is not limited to the vertical type of chamber, since it can be applied to the structure shown in FIGS. 1 and 2, and also similar type of inlet ducts 6 can be provided on the respective sides of the chamber 5.

Since the dust collecting apparatus according to the present invention is constructed as described above, and more particularly, since the end portion of the hanger support having the discharge electrodes fixed thereto is secured to the casing externally thereof and is insulated from the casing, electrical insulation for the circuitry of the discharge electrodes is excellent. Hence even in the case of collecting electrically conductive dust such as, for example, carbon particles, lowering of the electric insulation will scarcely occur. In addition, since the dust deposited on the dust collecting electrode is always compressed a cake between the belt-shaped dust collecting electrode and the roller and then peeled off in the form of a cake by the scrapers, the problem of resputtering of the dust will not occur. Moreover, since the dust collecting electrode operates always in a scraped or wiped condition, the dust collecting effect can be maintained always in the best condition. Thus, the apparatus according to the present invention has the advantage that the necessity for provision of a hammering or other impacting device, as is the case with the conventional electric dust collecting apparatuses, can be completely eliminated.

Furthermore, if the structure according to the present invention is employed, the longitudinal cross-section area as well as other dimensions of the apparatus can be reduced into a compact form and the apparatus can be installed in any desired orientation, and hence, various additional advantages can be obtained such that the problems of installation space and an installation location can be resolved.

What is claimed is:

1. An electric dust collecting apparatus having a casing; an elongated charging electrode extending lengthwise of said casing; a roller rotatably supported at each of the opposite ends of the casing; a driven endless belt-like dust collecting electrode extending between and around said rollers and forming a chamber surrounding said charging electrode; a pair of gas exhaust ports formed in and communicating through said casing; hanger supports for said charging electrode positioned and arranged in each of said gas exhaust ports; said charging electrode being suspended therebetween; electrical insulating means securing said hanger supports to said casing externally thereof; a gas inlet port between and spaced from both of said gas exhaust ports for introducing gas through said casing; said gas inlet port and said gas exhaust ports positioned and arranged with respect to said chamber such that gas will flow through said chamber between said gas inlet port and said exhaust ports.

2. An electric dust collecting apparatus as described in claim 1 wherein the dust collecting surface of said endless collecting electrode is directed inwardly of said chamber and toward the surfaces of said rollers at opposite ends of said chamber whereby said rollers compress the dust collected on the surface of said collecting electrode into a cake-like mass.

3. An electric dust collecting apparatus as described in claim 2 wherein a scraper is provided adjacent each of said rollers such that said scrapers contact said endless collecting electrode as it separates from the adjacent roller.

4. An electric dust collecting apparatus as described in claim 3 wherein conveying means is provided adjacent each of said scrapers for removing from said casing caked dust scraped from said endless electrode.

5. An electric dust collecting apparatus as described in claim 4 wherein said conveyor means is a screw conveyor.

6. An electric dust collecting apparatus as described in either claims 3 or 4 wherein a partition is provided adjacent each of said scrapers, each partition being between the adjacent end of said charging electrode and one of said scrapers.

7. An electric dust collecting apparatus as described in claim 2 wherein each of said electrical insulating means is a U-shaped support element projecting outwardly on opposite sides of said casing, the legs of said support element being of electrically insulative material.

8. An electric dust collecting apparatus as described in either claims 1 or 7 wherein said hanger supports are centered in said gas ports.

9. An electric dust collecting apparatus as described in either claims 1 or 2 wherein the axes of said rollers and of said hanger supports and the plane of said endless electrode are vertical.

10. An electric dust collecting apparatus having a casing; an elongated charging electrode extending lengthwise of said casing; a roller rotatably supported at each of the opposite ends of the casing; a driven endless belt-like dust collecting electrode extending between and around said rollers and forming a chamber surrounding said charging electrode; a pair of exhaust gas ports formed in and communicating through said casing with said chamber; a hanger support for said charging electrode positioned and arranged in each of said exhaust gas ports; said hanger supports extending externally of said casing; electrical insulating means securing said external ends of each of said hanger supports to said casing externally thereof; an inlet gas port spaced from both of said exhaust gas ports communicating with said chamber; said inlet port and said exhaust gas ports positioned and arranged to cause gas to flow through said chamber between said gas inlet port and said gas exhaust ports and between said charging and collecting electrodes.

11. An electric dust collecting apparatus having a casing, a plurality of rollers rotatably supported at each of opposite ends of said casing; a driven endless belt-like dust collecting electrode trained over said rollers to form a plurality of spaced runs extending lengthwise of said casing between said rollers; said runs of said endless electrode forming a plurality of parallel chambers therebetween; a plurality of hanger supports, one adjacent each end of each of said chambers; each of said hanger supports projecting externally of said casing; electrical insulating means supporting each of said hanger supports on said casing externally thereof; a charging electrode mounted to and supported on and between said hanger supports in each of said chambers, a pair of gas exhaust ports, one adjacent each of the opposite ends of said chambers and communicating with each of said chambers; said hanger supports being positioned and arranged in said exhaust gas ports; a gas inlet port between and spaced from both of said gas exhaust ports and communicating with each of said chambers; said gas exhaust ports positioned and arranged with respect to said gas inlet port to provide a path for air to enter, flow through and exhaust from each of said chambers whereby the gas may be caused to flow between the charging and collecting electrodes in each of said chambers.

12. An electric dust collecting apparatus as described in claim 11 wherein said endless electrode has a dust collecting surface directed toward said charging electrode in each chamber, said rollers being arranged such that the dust collecting surfaces of said collecting electrode engage a roller surface at each end of each of said chambers for compressing the dust collected thereon between the surface and the roller into a cake-like mass.

13. An electric dust collecting apparatus as described in claim 12 wherein a scraper is provided adjacent each of said rollers said scrapers being positioned such that they have contact said endless electrode as it separates from an adjacent roller.

14. An electric dust collecting apparatus as described in claim 13 wherein conveying means is provided adjacent each of said scrapers for removing from said casing caked dust scraped from said endless electrode.

15. An electric dust collecting apparatus as described in either claims 13 or 14 wherein a partition is provided in each of said chambers adjacent each of said scrapers, each partition being between the adjacent end of said charging electrode and one of said scrapers.

* * * * *

UNITED STATES PATENT AND TRADEMARK OFFICE

CERTIFICATE OF CORRECTION

PATENT NO. : 4 321 066

DATED : March 23, 1982

INVENTOR(S) : Senichi Masuda

It is certified that error appears in the above—identified patent and that said Letters Patent is hereby corrected as shown below:

Column 1, lines 40-41:

"as projected" should be --on insulators.

Projecting--

Column 2, line 37:

"extended" should be --as it extends--

Column 4, line 44:

Delete "owing"

Column 5, line 4:

After "compressed" insert --into--

Column 7, line 2:

Delete "have" and insert --each--

Signed and Sealed this

Twentieth Day of July 1982

[SEAL]

Attest:

GERALD J. MOSSINGHOFF

Attesting Officer

Commissioner of Patents and Trademarks